US007976415B2

(12) United States Patent
Burt

(10) Patent No.: US 7,976,415 B2
(45) Date of Patent: Jul. 12, 2011

(54) RACKET WITH VERSATILE HANDLE

(76) Inventor: Lionel J. Burt, Torrance, CA (US)

( * ) Notice: Subject to any disclaimer, the term of this patent is extended or adjusted under 35 U.S.C. 154(b) by 0 days.

(21) Appl. No.: 11/703,321

(22) Filed: Feb. 6, 2007

(65) Prior Publication Data

US 2007/0184924 A1 Aug. 9, 2007

Related U.S. Application Data

(60) Provisional application No. 60/765,500, filed on Feb. 6, 2006.

(51) Int. Cl.
*A63B 49/08* (2006.01)

(52) U.S. Cl. ..... 473/549

(58) Field of Classification Search ..... 473/549, 473/55, 552, 526; D21/729
See application file for complete search history.

(56) References Cited

U.S. PATENT DOCUMENTS

| | | | | |
|---|---|---|---|---|
| 335,656 | A | 2/1886 | Taylor | |
| 703,911 | A | 7/1902 | Girdwood | |
| 2,147,110 | A | 2/1939 | Schmid | |
| 2,753,186 | A * | 7/1956 | Kleinman | 473/551 |
| 2,795,426 | A | 6/1957 | Wood | |
| 3,545,755 | A | 12/1970 | Owada | |
| D247,059 | S | 1/1978 | Simmoneau | |
| D247,131 | S | 1/1978 | Simmoneau | |
| 4,221,383 | A | 9/1980 | Cappelli | |
| 4,720,106 | A * | 1/1988 | Bickham | 473/521 |
| 4,721,305 | A * | 1/1988 | Cudlip | 473/526 |
| 4,746,119 | A | 5/1988 | Jeanrot | |
| 4,861,030 | A | 8/1989 | Burt | |
| 5,183,260 | A | 2/1993 | Kheir | |
| 5,366,218 | A * | 11/1994 | Gong | 473/551 |
| 5,431,394 | A * | 7/1995 | Stewart | 473/526 |
| 5,762,572 | A | 6/1998 | Chuang | |
| 5,816,958 | A | 10/1998 | Seymour | |
| 6,435,991 | B1 * | 8/2002 | Kishek | 473/551 |
| 2007/0184924 | A1 * | 8/2007 | Burt | 473/549 |

* cited by examiner

*Primary Examiner* — Raleigh W. Chiu

(57) ABSTRACT

A racket. In an illustrative embodiment, the racket includes plural handle portions, including a first handle portion and a second handle portion, which are equipped with a first gripping surface and a second gripping surface, respectively. A first mechanism couples the first handle portion and the second handle portion to the racket so that the first gripping surface is angled relative to a first plane coincident with a hitting surface of the racket. In a more specific embodiment, the first handle portion and the second handle portion are integrated with the racket. Alternatively, the first handle portion and the second handle portion are removably attached to the racket. The first and second handle portions form obtuse angles between the hitting surface and the handle portions.

8 Claims, 5 Drawing Sheets

RACKET WITH VERSATILE HANDLE

CLAIM OF PRIORITY

This invention claims priority from U.S. Provisional Patent Application Ser. No. 60/765,500, entitled NATURAL RACQUET, DUAL-GRIP DESIGN, filed on Feb. 6, 2006, which is hereby incorporated by reference as if set forth in full in this specification.

BACKGROUND OF THE INVENTION

1. Field of Invention

This invention relates to rackets. Specifically, the present invention relates to performance-enhancing handles and accompanying rackets, sticks, clubs, paddles, and so on.

2. Description of the Related Art

Performance-enhancing handles are employed in various demanding applications including tennis rackets, ping pong paddles, badminton rackets, hockey sticks, and golf clubs. Such applications often demand handles and accompanying rackets that resist slipping in the hands, maximize comfort, minimize shock and injury potential, and maximize racket control and stability.

High performance handles and accompanying grips are particularly important in tennis-racket applications, where repeated precise striking of high-speed balls is particularly demanding. For example, minimal deviations in racket-head position and orientation may cause large deviations in ball trajectory. Consequently, the player must accurately time the meeting of the racket and the ball and control the orientation of the racket upon impact with the ball. Furthermore, the hands typically sweat during tennis, reducing grip effectiveness, further complicating racket-head control. In addition, repeated shock may lead to tennis elbow and other injuries. Furthermore, repeated use of one hand for most tennis strokes may cause undesirable asymmetrical muscular development.

To improve racket-grip performance and to reduce shock, special grip overwraps are employed. The overwraps cover existing grips, adding an absorptive layer between the hand and the racket handle for absorbing sweat and shock. Unfortunately, such overwraps often have minimal shock-absorbing capabilities and readily lose effectiveness when saturated with sweat.

To improve racket performance, racket heads are often modified. For example, to enlarge the racket sweet spot, racket heads are often enlarged. Unfortunately, larger head rackets may be less maneuverable and undesirably susceptible to twisting during ball contact.

To reduce fatigue-related injuries, rackets are often made lighter. Unfortunately, lighter rackets may actually transmit more shock to the hand, wrist, and arm, actually increasing injury risk.

To improve racket stability upon contact, rackets are often made stiffer. Unfortunately, stiffer rackets may also increase injury risk by increasing shock to the hand, wrist, and arm.

Alternatively, tennis players adjust their strokes and body mechanics to accommodate racket deficiencies. For example, players may contact the ball further in front of the body, where the ball, court, and opponent are more clearly visible. To maximize the forward position of the contact point with the racket squared to the oncoming ball, the racket is oriented approximately ninety degrees relative to the forearm at impact. Unfortunately, such racket-forearm orientations require extreme wrist orientations, which may promote injuries and reduce racket-head control.

Hence, a need exists in the art for a high-performance handle and accompanying racket that minimizes injury risks and that maximizes grip and racket performance and functionality.

SUMMARY OF THE INVENTION

The need in the art is addressed by the racket of the present invention. In a specific embodiment, the racket includes a first handle portion with a first gripping surface and a second handle portion with a second gripping surface. A first mechanism couples the first handle portion and the second handle portion to a racket so that the first gripping surface is angled relative to a racket face.

In a more specific embodiment, the first handle portion and the second handle portion are made integral to the racket. The second gripping surface is also angled relative to the racket face when the second handle portion is coupled to the racket. The first handle portion forms an obtuse angle between the racket face and the first handle portion when coupled to the racket via the first mechanism. Similarly, the second handle portion forms an obtuse angle between the racket face and the second handle portion when coupled to the racket via the first mechanism.

In the illustrative embodiment, the racket further includes a sixth mechanism for varying the obtuse angle. The sixth mechanism includes one or more removable shims between the first handle portion and a shaft of the racket. A seventh mechanism facilitates selectively controlling the overall length of the racket by sliding the first handle portion and the second handle portion along the racket shaft. An eighth mechanism facilitates changing an angle between the first gripping surface or the second gripping surface relative to a plane coincident with a longitudinal axis of the racket and perpendicular to the racket face.

The novel design of certain embodiments of the present invention, such as the use of strategically angled handle sections, may enhance user hitting options, promote ambidexterity and body symmetry, improve racket stability and performance, promote grip drying, reduce injury risk, facilitate contacting tennis balls or other balls further in front of the body, and so on.

DESCRIPTION OF THE INVENTION

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

For the purposes of the present discussion, a handle may be any means for gripping a device. Accordingly, a handle may be a single physical unit or may include different portions positioned at different locations on the surface of a device, such as a tennis racket or other equipment. A racket may be any hand-held device preferentially used to contact a projectile. Examples of rackets include tennis rackets, badminton rackets, ping pong paddles, hockey sticks, golf clubs, baseball bats, lacrosse sticks, and so on. A racket frame may be any structure forming part of a racket.

For clarity, various well-known components, such as grip pallets, grommet strips, and so on, have been omitted from the figures. However, those skilled in the art with access to the present teachings will know which components to implement and how to implement them to meet the needs of a given application.

Figure 1:
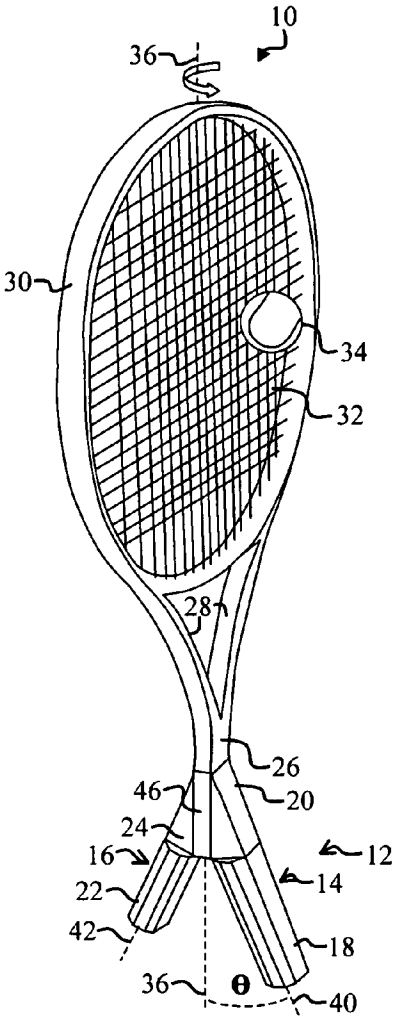
FIG. 1 is a perspective view showing a racket with a dual handle according to a first embodiment of the present invention.

FIG. 1 is a perspective view showing a racket 10 with a dual handle 12 according to a first embodiment of the present invention. The dual handle 12 includes a first handle portion 14 and a second handle portion 16. The first handle portion 14 includes a first gripping surface 18 abutting a first coupling section 20. Similarly, the second handle portion 16 includes a second gripping surface 22 abutting a second coupling section 24. The first handle portion 14 and the second handle portion 16 are coupled to a racket shaft 26 via a substantially rigid box structure 46 between the first coupling section 24 and the second coupling section 20. The racket shaft 26 extends from the dual handle 12 to a racket throat 28, which is coupled to an oval racket head 30. The racket head 30 surrounds a substantially planar string bed 32, which represents a racket face, hitting surface, or string bed of the racket 10 for hitting a tennis ball. A longitudinal axis 36 of the racket is coincident with the racket shaft 26 and approximately bisects the racket face 32. The racket sections 26, 28, 30 comprise a racket frame.

For the purposes of the present discussion, a hitting surface may be any surface or region of a device, such as a racket, that is adapted to make contact with a projectile or other device.

In the present specific embodiment, the substantially rigid box structure 46 of the dual handle 12 substantially surrounds the racket shaft 26. The rigid box structure 46 is open on top and bottom ends so that the racket shaft 26 may slide within the box structure 46 during assembly of the racket 10 or during length adjustments, as discussed more fully below. For the purposes of the present discussion, a rigid structure may be any device or structure that is sufficiently rigid to secure a handle thereto for a particular application.

In this embodiment, the first handle portion 14 and the second handle portion 16 are implemented via shafts that are angled relative to the racket longitudinal axis 36 by a predetermined angle θ. For illustrative purposes, the angle θ is measured between the racket longitudinal axis 36 and a longitudinal axis 40 of the first handle portion 14. The second handle portion 16 is associated with a second longitudinal axis 42. The racket longitudinal axis 36 and both handle longitudinal axis 40, 42 lie in a plane that is approximately perpendicular to the racket face 32. Note however, that the angular orientation of the handle portions 14, 16 relative to each other, the racket face, and the racket longitudinal axis 36 may be adjusted without departing from the scope of the present invention.

The substantially rigid box structure 46 may be welded or otherwise bonded or screwed to the first coupling section 20 and the second coupling section 24 on opposite sides of the box structure 46. The box structure 46 and accompanying handle portions 14, 16 may then slide over the racket shaft 26 and be screwed or otherwise bonded thereto. Alternatively, the handle portions 14, 16, box structure 46, and racket throat 26 are seamlessly connected. For example, the sections 14, 16, 26, 28 may be integrally formed, such that the sections 14, 16, 28, 26 are part of the same piece of material. In such implementations, the racket 10 may be formed in a mold, such as via a composite lay-up process. A handle is said to be made integral with a racket when the racket and at least a portion of the handle are made from the same piece of material.

Exact details pertaining to materials and methods employed to make the racket 10 are application specific. Those skilled in the art with access to the present teachings will readily know which materials and methods to use to meet the needs of a given application. For example, in some applications, such as tennis racket applications, epoxy resins and carbon fibers may be employed, while in other applications, the racket 10 may be carved out of wood and employed as a ping pong paddle.

In operation, a user grips the handle portions 14, 16 as desired in preparation for hitting a ball, such as a tennis ball 34. Conventional grips, such as the Western grip, Eastern grip, Continental grip, and so on may be employed to selectively grip the gripping surfaces 18, 22. Furthermore, one or two hands may be employed in various gripping configurations.

The racket 10 provides new options for various shots, strokes, and grips. For example, a user may grip the first handle portion 14 with a Western grip as though to hit a forehand shot, then flip the racket face 32 to hit a shot behind the body. Furthermore, the angles of the handle portions 14, 16 relative to the racket longitudinal axis 36 and the racket face 32 may facilitate contacting the ball 32 further in front of the body; may reduce or prevent undesirable twisting of the gripping surfaces 18, 22 even when wet; may enable less extreme wrist angles when striking the ball 34 in front of the body; may facilitate adjusting the ball contact position further in front of the body by merely sliding a hand or hands further down the first gripping surface 18 and/or second gripping surface 22; may promote ambidextrous play by facilitating switching the racket 10 between hands; may thereby reduce injuries by promoting symmetrical muscle development; may reduce wrist and arm shock and associated injuries by distributing shock among both hands; may improve the stability of the racket 10 upon impact by increasing the stability of the center of gravity of the racket 10 and increasing rotational inertia of the racket 10, thereby increasing the size of the racket sweet spot; and so on, as discussed more fully below.

Figure 2:
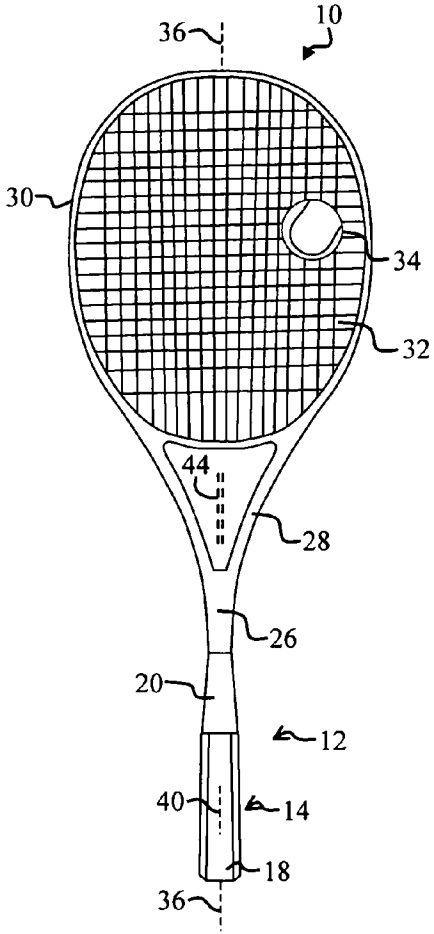
FIG. 2 is a front view of the racket and dual handle of FIG. 1.

FIG. 2 is a front view of the racket 10 and dual handle 12 of FIG. 1. In this specific embodiment, a plane, shown graphically as two dashed lines 44, is perpendicular to the racket face 32 and is coincident with the racket longitudinal axis 36. The longitudinal axis 40 of the first handle portion 14 is also coincident with the racket longitudinal axis 36.

Figure 3:
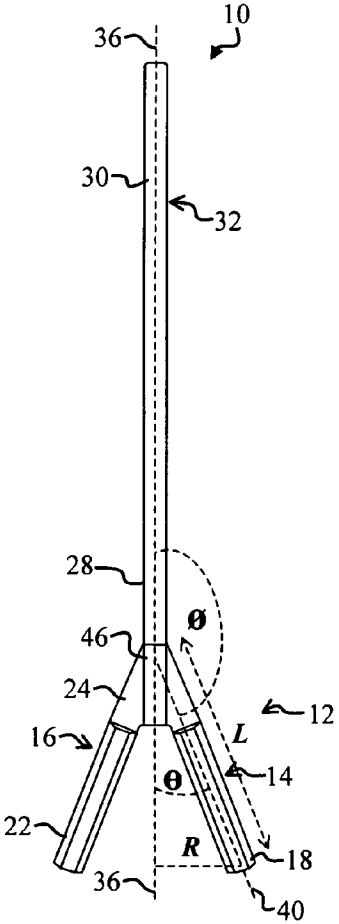
FIG. 3 is a side view of the racket and dual handle of FIG. 1.

FIG. 3 is a side view of the racket 10 and dual handle 12 of FIG. 1. The longitudinal axis 40 of the first handle portion 14 forms an acute angle (θ) relative to a portion of the racket longitudinal axis 36 that extends below the rigid box structure 46. Similarly, the first handle portion 14 forms an obtuse angle (ø) between the racket face 32 and the first handle portion 14. The obtuse angle ø may be varied by adjusting the acute angle θ and vice versa.

The furthest perpendicular distance between the racket longitudinal axis 36 and the handle longitudinal axis 40 in the first handle portion 14 is denoted R, while the length of the first handle portion 14 as measured along the handle longitudinal axis 40 is denoted L. A variable describing the perpendicular distance between the racket longitudinal axis 36 and the handle longitudinal axis 40 is denoted r. Similarly, a variable describing different positions along the handle longitudinal axis 40, measured from the vertex of the acute angle θ, is denoted l.

Use of the dual handle 12 may increase the rotational stability of the racket 10 by increasing the rotational inertia about the racket longitudinal axis 36. This may enhance racket performance; may facilitate gripping the racket 10; and may reduce twisting of the racket 10 upon ball contact, potentially reducing injury risk.

The rotational inertia of a body is a measure of the resistance the body offers to a change in its rotational motion about a given axis. Generally, the rotational inertia (I) of a mass (such as the first handle portion 14) comprising plural differential masses (dm), the differential masses of which are positioned varying distances r from an axis (such as the racket axis 36) is given by the sum of the products between the differential masses dm and the corresponding radii squared ($r^2$), as indicated by the following equation:

$$I=\int r^2 dm. \quad [1]$$

To simplify calculations, the mass of the first handle portion 14 is considered to be concentrated about the handle longitudinal axis 40. Since the radius of the handle portion 40 itself is relatively small, such approximation will be suitable for the present purposes. Furthermore, for the sake of discussion, the mass of the dual handle 12 is approximately ¾ of the mass of the racket head 30 and face 32.

Each differential mass dm of the first handle portion 14 is described by:

$$dm=\rho dV, \quad [2]$$

where, ρ is the average density of the material employed to construct the first handle portion 14, and where dV is the differential volume associated with the differential mass dm. Note that l, r, dl and dr are related by the following relation:

$$\frac{dl}{dr}=\frac{l}{r}=\frac{L}{R}. \quad [3]$$

Consequently:

$$\rho dV=\rho A dl=\rho A\frac{L}{R}dr=dm, \quad [4]$$

where A is the perpendicular cross-sectional area of the first handle portion 14.

Substituting equation (4) into equation (1) and solving yields:

$$\begin{aligned} I &= \int r^2 dm \\ &= \int_0^R r^2 \rho A \frac{L}{R} dr \\ &= \frac{\rho AL}{R}\int_0^R r^2 dr \\ &= \frac{\rho AL}{R}\left(\frac{R^3}{3}\right) \\ &= \frac{MR^2}{3}, \end{aligned} \quad [5]$$

where ρAL=M, the mass of the first handle portion 14.

Using a similar procedure, the combined rotational inertia ($I_{HEAD}$) of the racket head 30, shaft 26, and throat 28, is roughly approximated as:

$$I_{HEAD}=\frac{M_{HEAD}R_{HEAD}^2}{2}, \quad [6]$$

where $R_{HEAD}$ is the radius of the racket head 30, and $M_{HEAD}$ is the mass of the racket head 30, including the racket shaft and throat 28.

Considering that the mass of the first handle portion is approximately ¾ of $M_{HEAD}$ in the present embodiment, i.e., $M=(3/4)M_{HEAD}$, the ratio between the rotational inertia of the racket head 30 and the combined rotational inertia of the first handle portion 14 and the second handle portion 16 is given by the following equation:

$$\frac{2MR^2}{3}\Big/\frac{M_{HEAD}R_{HEAD}^2}{2}=\frac{R^2}{R_{HEAD}^2}. \quad [7]$$

Assuming, for simplicity, that the mass of a conventional racket handle is concentrated about the racket longitudinal axis 36, i.e., a conventional handle has a substantially negligible rotational inertia, and further assuming that the radius (R) of the dual handle 12 is approximately equal to the radius ($R_H$) of the racket head 30, then equation (7) above is approximately equal to 1. This would suggest a 100% increase in the rotational inertia of the racket 10 due to the dual handle 12. Such a substantial increase in racket rotational inertia may improve racket stability and performance. Note that even slight improvements in twisting stability of the racket head 30 are magnified when considering that only a slight deviation in the face of the racket head 30 can result in the tennis ball 34 flying out of a tennis court or into a net.

Furthermore, note that the handle section 12 may increase the stability of the center of gravity of the racket 10 by dispersing weight on either side of the longitudinal axis 36 of the racket 10. This effect can be observed by attempting to balance the racket on edge by placing a finger near the throat 28. The racket 10 is much easier to balance on edge than a conventional racket. A racket is balanced in the vertical plane when its center of mass is coincident with the base of support or point of suspension in a line parallel to the direction of gravity. How exactly this improved balancing ability affects the behavior of the racket 10 during play remains an area of active research. However, physical observations suggest that the new weight distribution and balance of the racket 10 greatly improves the stability of the racket head and appears to unexpectedly improve the size of the perceived sweet spot of the racket 30.

The region of the racket face 32 in which the ball 34 can strike the racket 10 while producing a given rotational deflection apparently increases, which may increase the sweet spot. Increased sweet-spot size may represent a previously unrecognized benefit resulting from improved rotational stability of the racket 10.

Furthermore, the dual handle 12 may reduce twisting torque about the longitudinal axis 40, 42 associated with the gripping surfaces 18, 22. For example, when the ball 34 contacts the racket face 32 off center, i.e., away from the longitudinal axis 36, resulting forces tend to cause the handles 14 to pivot in the hands rather than twist parallel to the longitudinal axis 40, 42, as discussed more fully below. This shift in racket-hand mechanics may further improve the rotational stability of the racket 60, thereby further increasing the perceived racket sweet spot.

Offsetting the two handle portions 14, 16 relative to the perpendicular plane 44 of FIG. 2, may further improve racket balance by lowering the center of gravity of the racket 10 when the racket is oriented to contact an oncoming ball, as discussed more fully below with reference to FIG. 8. Note that the rotational stability of the racket 10 is further enhanced by increased racket rotational inertia about the longitudinal axis 36, irrespective of the balancing effects on the racket afforded by the handle sections 14, 16 and their interaction with gravity.

Figure 4:
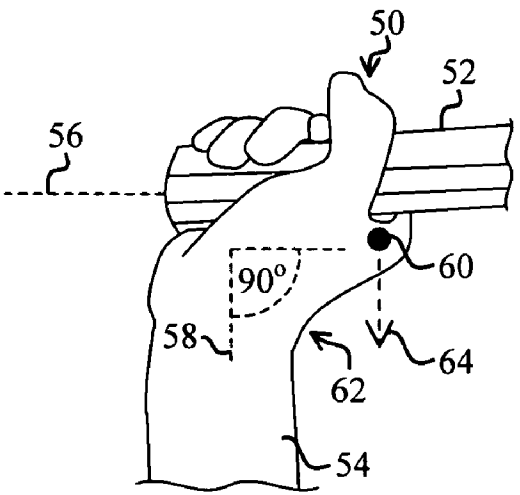
FIG. 4 illustrates a wrist orientation when gripping a conventional racket handle so that a user's forearm forms an approximately ninety-degree angle with the racket.

FIG. 4 illustrates a hand 50 and wrist 62 orientation when gripping a conventional racket handle 52 so that a user's forearm 54 forms an approximately ninety degree angle with a longitudinal racket axis 56. In this prior art depiction, the single handle 52 is aligned with the longitudinal racket axis 56. The handle 52 is gripped with a Western grip. In this position, the hand 50 and wrist 62 are in an extreme configuration. The wrist 62 typically cannot bend backward more than shown in FIG. 4 without injury or discomfort. Use of such extreme wrist configurations may increase injuries.

Note that upon racket contact with a ball, the handle 52 presses against the hand 50 at a pivot point 60, which is near the base knuckle of the index finger. This results in an aft force vector 64 that is offset relatively far from the forearm longitudinal axis 58. However, preferably, for enhanced racket stability, the pivot point 60 would be closer to the forearm longitudinal axis 58, enabling the forearm 54 to more readily support the force corresponding to the force vector 64.

Furthermore, in the hand/wrist orientation shown in FIG. 4, when a user contacts a ball off-center, i.e., away from the centerline of the corresponding racket head, the grip 52 experiences a twisting moment about the longitudinal racket axis 56. This twisting is particularly problematic and may cause the grip 52 to excessively wear; may promote injuries to the wrist 62; and may cause the grip 52 to slip in the hand, especially when the grip 52 is wet.

Figure 5:
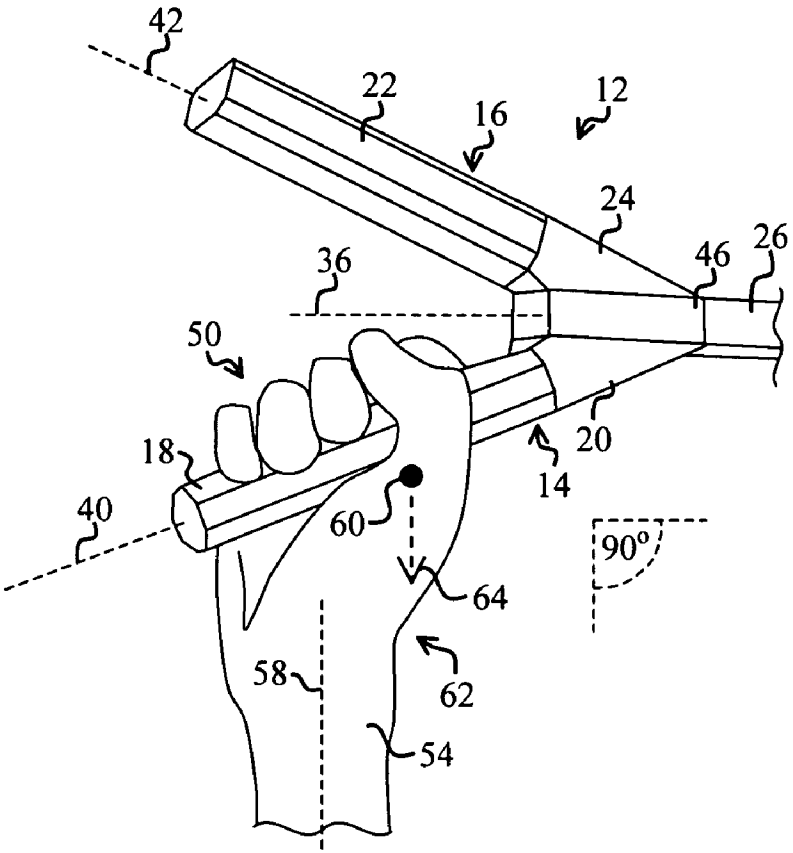
Fig. 5 Prior Art
FIG. 5 illustrates a wrist orientation when gripping the racket of FIG. 1 so that an approximately ninety-degree angle occurs between the user's forearm and the racket.

FIG. 5 illustrates a wrist orientation when gripping the racket 10 of FIG. 1 so that an approximately ninety-degree angle occurs between the user's forearm 54 and the racket longitudinal axis 36. With reference to FIGS. 1, 4, and 5, the hand 50 is shown gripping the first handle portion 14 via a Western grip.

Note that in this position, the racket longitudinal axis 36 is offset forward of the hand 50 so that the racket face 32 is closer to an oncoming ball. Consequently, the contact point is further in front of the body, where the court, the ball, and the opponent are more clearly visible, and where a user can more readily get his or her weight behind a shot. One can adjust how far out front of the body that ball contact is made by selectively positioning the hand 50 at different positions along the first handle portion 14. For example, to shift the contract point further forward, the hand 50 is shifted aft toward the end of the first handle section 14. This effectively moves the racket longitudinal axis 36 further forward of the hand 50.

Furthermore, the pivot point 60 of FIG. 5 has shifted closer to the forearm longitudinal axis 58 relative to the pivot point 60 of FIG. 4, enabling the forearm 54 to more readily support forces 64 transmitted to the hand 50 via the pivot point 60. This may yield improved racket stability.

In addition, the wrist 62 is in a less extreme or injury prone orientation than the conventional orientation shown in FIG. 4. In fact, the wrist 62 is less contorted by an angle of approximately θ, which corresponds to the angle between the longitudinal axis of the first handle portion 14 and the racket longitudinal axis 36. For example, without the dual handle 12, i.e., with the single handle 52 of FIG. 4, the wrist 62 must be further contorted so that the handle longitudinal axis 40 aligns with the racket longitudinal axis 36. This is particularly problematic for Eastern and Continental grips.

The wrist configuration shown in FIG. 5 may reduce injury risk and may increase racket stability and wrist freedom when compared to the wrist configuration as shown in FIG. 4. Improved wrist freedom may facilitate more versatile shot making. The wrist 62 is said to have improved wrist freedom, as the wrist 62 is not limited by an initial extreme wrist orientation.

Note that the elbow is often employed to compensate for the inability of the wrist 62 to achieve the desired ninety-degree angle between the racket face 32 and the forearm 54. This is thought to promote tennis elbow. Accordingly, use of rackets equipped with the dual handle 12 may not only enhance comfort by enabling less extreme wrist positions during ball contact, but may reduce injuries associated with extreme elbow orientations.

Furthermore, when the ball 34 of FIG. 1 hits the racket face 32 off center, grip twisting forces and associated motion that would ordinarily occur with a conventional single-handle racket, are converted to forces acting to deflect the longitudinal axis 40 of the first handle portion 14. Such forces are more readily controlled by the muscles of the wrist 62 and hand 50. Hence, in the extreme case, with the forearm 54 oriented ninety degrees with respect to the shaft 26 the racket 10, a twisting deflection of the racket head 30 due to an off-center ball contact creates a rotational moment of the handle portion 14 about the longitudinal axis 36 rather than a twisting moment about the longitudinal axis 40 of the first handle portion 14. This rotational moment causes the handle longitudinal axis 40 to pivot in the hand so that the portion of the first handle portion 14 furthest from the racket longitudinal axis 36 deflects more than the portion of the handle closest to the longitudinal axis 36. An axis is said to pivot if it tends to angularly deflect unless acted upon by a stabilizing force, such as a stabilizing force provided by the hand 50. An axis is said to angularly deflect if it rotates about an axis other than itself.

Such rotational motion, as opposed to twisting motion, may facilitate gripping the racket 30 when the gripping surface 18 is wet. Furthermore, note that if one gripping surface 18 becomes wet, a user may simply switch their hand to the other gripping surface 22, allowing the wet gripping surface 18 to dry. Note that strategic use of both gripping surfaces 18, 22 may prevent any one from becoming wet or slippery, and even if the gripping surfaces 18, 22 become wet, they are less likely to slip in the hands due to the geometries of the dual handle 12.

Accordingly, the racket 10 of FIGS. 1-3 and 5, may be considered a racket that comprises a hitting surface 32 and a handle 12 that includes a first handle shaft 14 and a second handle shaft 16, wherein the handle 12 is coupled to the hitting surface 32 so that certain twisting motion about a longitudinal axis 36 of the racket 10 is converted to motion acting to displace a longitudinal axis 40, 42 of the first handle shaft 14 and the second handle shaft 16. The longitudinal axis 40 of the first handle portion 14 is approximately parallel to the gripping surface 18 of the first handle portion 14.

Alternatively, the racket 30 may be considered to be a multi-handled racket 10 that includes a hitting surface 32 and a multi-handle 12 that has a first handle shaft 14 and a second handle shaft 16, wherein the multi-handle 12 is coupled to the hitting surface 32 so that when the multi-handle 12 is gripped via a hand of a user, that a pivot point 60 of the racket about the hand moves closer to alignment with a longitudinal axis 58 of a forearm 54 of the user as compared to a pivot point 60 of a single-handled racket with a single handle 54 that is coincident with a longitudinal axis 56 of the single-handled racket, when the single-handled racket is gripped similarly to the multi-handled racket 10.

Racket handles are said to be gripped similarly if corresponding facets of the handles are oriented similarly relative to hand features. For example, two handles gripped similarly may both be held via a so-called Western grip, an Eastern Grip, a Continental grip, and so on.

Hence, use of the dual handle 12 may facilitate holding and stabilizing the racket 30 when the grip 18 is wet or slippery. In addition, a user may grasp the second handle portion 16 with the opposite hand, thereby further stabilizing the racket 30 and reducing shock on any given body part by distributing shock among both hands, forearms, and so on. Such benefits and options may yield improved racket performance and reduced injury risk.

Furthermore, the dual handle 12 is particularly suited to ambidextrous play. For example, a user may grasp the first handle portion 14 with one hand to hit a forehand and then grasp the second handle portion 16 with the other hand to hit a forehand on the opposite side of the body with the opposite hand without having to awkwardly exchange or toss the racket from one hand to the other. Such versatility and user options may facilitate more symmetrical body muscular development, which may further reduce injury risk.

Hence, the racket 30 may provide additional hitting options; may facilitate contacting the ball in front of the body and with less extreme and more stable wrist orientations; may favorably change forces and pivot points relative to the hand 50, wrist 62, and forearm 54; may result in less racket-head deflection upon impact with a ball; may convert rotational or twisting movement of a conventional racket handle to pivoting motion of the dual handle 12, which is typically more controllable; may yield a wider weight distribution and corresponding less tendency to twist in general, as the handle portions 14, 16 increase racket rotational inertia about the longitudinal axis 36; may reduce shock; may promote muscular symmetry; may reduce injury risk; and so on.

Figure 6:
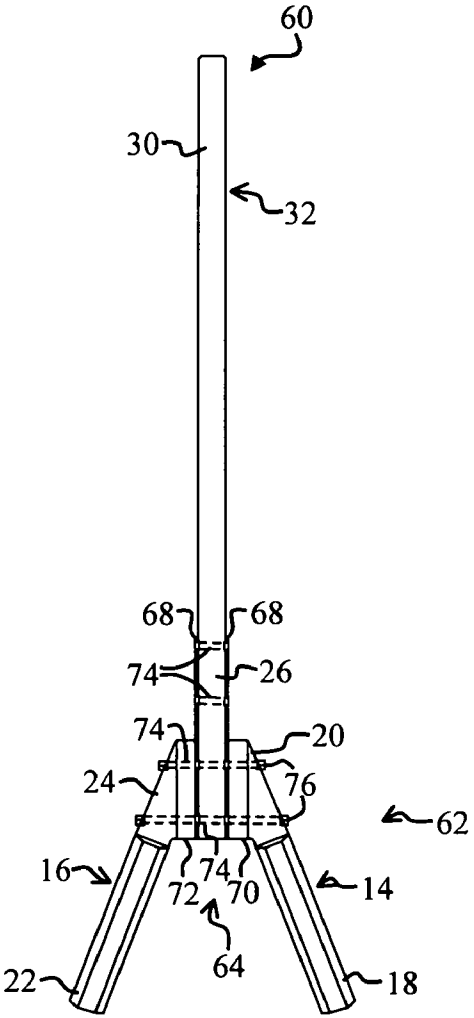
FIG. 6 is a side view of a racket with a dual handle that is attached to the racket via an adjustable connection mechanism.

FIG. 6 is a side view of a racket 60 with an alternative dual handle 62 that is attached to the racket 60 via an adjustable connection mechanism 64. The adjustable connection mechanism 64 includes a substantially rigid structure 68 on opposing sides of the racket shaft 26 facing the first handle portion 14 and the second handle portion 16. In the present embodiment, the rigid structure 68 is adapted to brace the racket shaft 26 and facilitate coupling the dual handle 62 to the racket 60. The rigid structure 68 provides mounting surfaces for the alternative dual handle 62. The rigid structure 68 may be implemented as a box structure that is connected on four or five sides. Alternatively, the rigid structure 68 may be implemented via separate plates. Note that the rigid structure 68 may be omitted without departing from the scope of the present invention.

For illustrative purposes, the connection mechanism 64 is shown including a first shim 70 between the first coupling section 20 of the first handle portion 14 and the rigid structure 68. A second shim 72 is positioned between the second coupling section 24 of the second handle section 16.

The first coupling section 20, second coupling section 24, first shim 70, second shim 72, rigid structure 68, and racket shaft 26 all have selectively positioned coincident holes there through. The parts 20, 24, 26, 68-72 are aligned so that the various holes form perforations 74 that extend through the parts 20, 24, 26, 68-72. The perforations 74 accommodate securing nuts and bolts 76 that fasten the parts 20, 24, 26, 68-72 together. The nuts and bolts 76 may be implemented via pins other connection mechanisms without departing from the scope of the present invention.

In this embodiment, the shims 70, 72 are relatively thick and act to widen the distance between the first gripping surface 18 and the second gripping surface 22 of the alternative dual handle 62. The shims are preferably made of lightweight durable material, such as carbon fiber and epoxy resin. The exact choice of material and weight is application specific and may be changed as needed to meet the needs of a given application. For example, special shock-absorbing elastic shims may be employed. Shims with strategic weight distributions and shapes may also be employed to tune the feel and balance of the racket 60 and to control the relative orientation of the handle sections 14, 16. For the purposes of the present discussion, a shim may be any material adapted to be positioned between two objects, devices, or materials.

Figure 7:
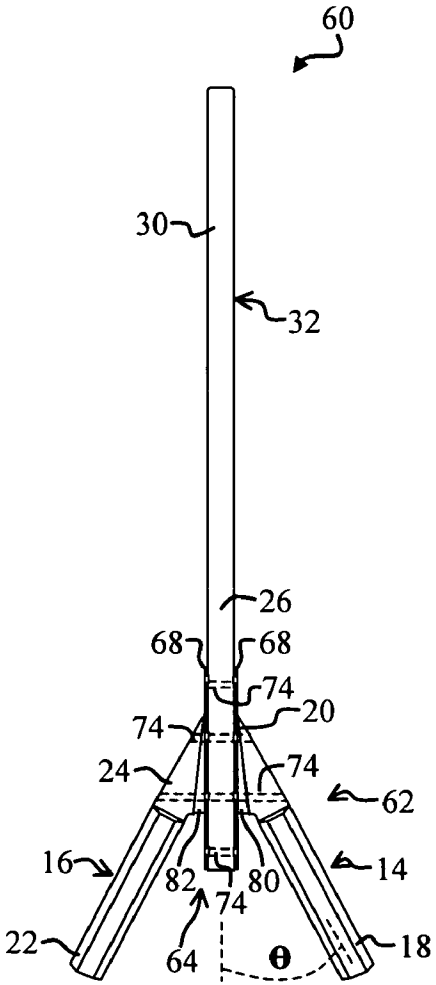
FIG. 7 is a side view of the racket of FIG. 6, wherein the adjustable-connection mechanism has been adjusted to shorten the racket, widen the angle between handles of the dual handle, and shorten the distance between the handles of the dual handle.

A user may easily change the shims 70, 72 by removing the connecting rods, e.g., nuts and bolts 76 coupling the dual handle to the racket shaft 26 and then inserting new shims with different dimensions, as illustrated in FIG. 7.

FIG. 7 is a side view of the racket 60 of FIG. 6, wherein the adjustable-connection mechanism 64 has been adjusted to shorten the racket 60, widen the angle between handles 14, 16 of the dual handle 62, and shorten the distance between the handles 14, 16 of the dual handle 62. With reference to FIGS. 6 and 7, in this embodiment, the racket shaft 26 and accompanying rigid structures 68 are shifted downward relative to the coupling sections 20, 24 of the handle sections 14, 16 so that holes through the coupling sections 24 align with different holes through the rigid structure 68 and the racket shaft 26. Accordingly, the connection 64 may also act as a mechanism for facilitating adjusting the length of the racket 60.

Furthermore, the shims 70, 72 of FIG. 6 have been replaced with shims 80, 82 that are selectively shaped to widen the angle θ between the handle sections 14, 16. The resulting perforations 74 are employed to fasten the various parts 80, 82, 20, 24, 68, 26 together in a new configuration.

While a particular configuration of perforations 74 is shown in FIGS. 6 and 7, different configurations, orientations, sizes, and numbers of perforations may be employed without departing from the scope of the present invention. For example, certain applications may employ angled perforations that are strategically angled to maximize the durability of the connection mechanism 64 and racket 60. Furthermore, while the shims 80, 82 are dimensioned and positioned to increase the angle θ between the handle sections 14, 16, the shims 80, 82 may be replaced with shims that act to tilt the gripping surfaces 18, 22 to either side, such as in directions parallel to the racket face 32. Similarly, the shims 80, 82 may be replaced with shims that act to decrease the angle θ. For example, the shims 80, 82 may be flipped vertically to decrease the angle θ.

Figure 8:
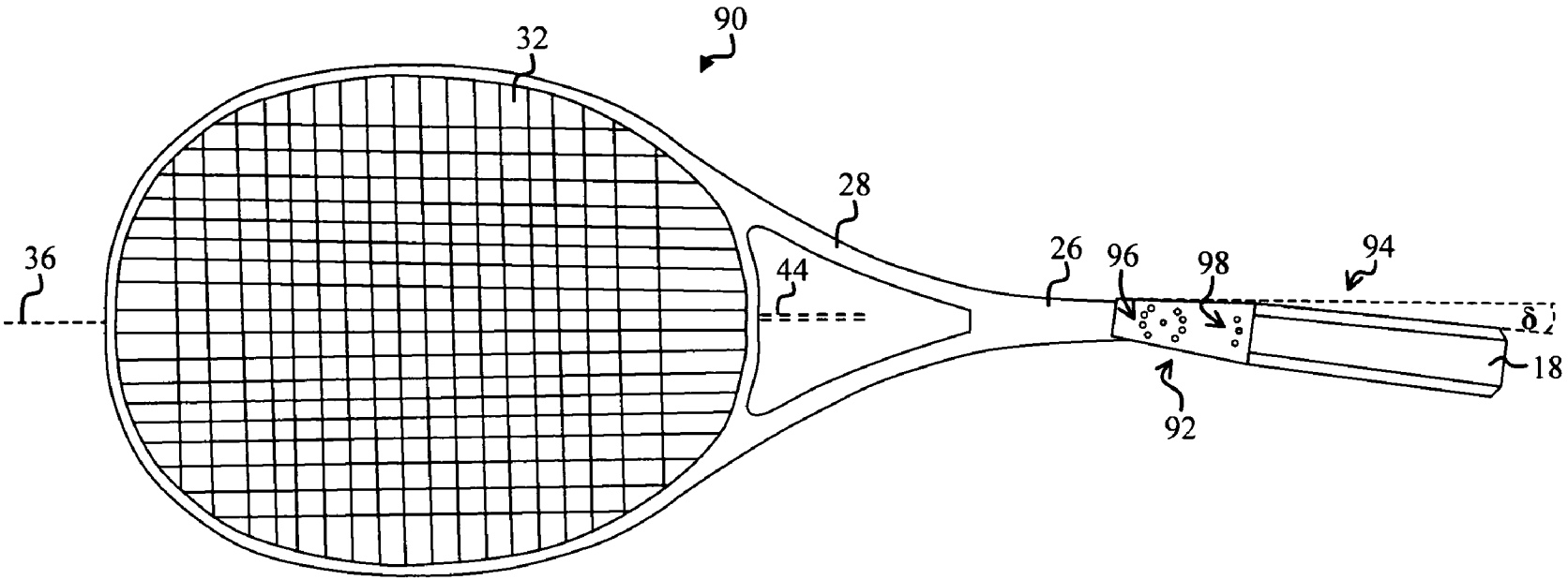
FIG. 8 is front view of an alternative embodiment of the racket of FIG. 7, wherein an alternative adjustable connection mechanism is employed to adjust an angle formed between the dual handles and a plane perpendicular to a face of the racket.

With reference to FIGS. 6, 7, and 8, FIG. 8 is front view of an alternative embodiment 90 of the racket 60 of FIGS. 6 and 7, wherein an alternative adjustable connection mechanism 92 is employed to adjust an angle (δ) formed between the dual handles 14, 16 and a plane perpendicular 44 to the racket face 32. A second alternative dual handle 94 is selectively coupled to the racket shaft 26 via various strategically positioned connection holes, including a first set of holes 96 and a second set of holes 98, which extend through the racket throat 26 and the connection mechanism 92.

To adjust the angle δ, enough fastening pins, screws, or other devices are removed from the holes 96, 98 to enable the handle to be rotated in a plane that is approximately parallel to the racket face 32, i.e., perpendicular to the perpendicular plane 44. The handle 94 is rotated until the holes 96, 98 align with a desired set of holes in the racket shaft 26. Connecting pins, screws, bolts, or other mechanisms are inserted into the corresponding perforations 96, 98 and tightened to secure the handle 94 to the racket 90.

Hence, the connection mechanism 92 allows selective adjustments of the angle δ relative to the gripping surface 18 of the handle 94 and the plane 44 perpendicular to the racket face 32. The perforations 96, 98 may also be employed to selectively adjust the length of the racket 90, as done in the embodiment in FIG. 7.

Note that offsetting the two handle portions 14, 16 relative to the perpendicular plane 44 of FIG. 2, lowers the racket center of gravity when the racket 90 is oriented to contact an oncoming ball. These affects on the center of gravity of the racket 90 may increase racket balance and stability. The effect of the handle 94 on racket balance is related to the effect that a balancing pole has when used by a tightrope walker. A related balancing effect can be visually observed by setting the racket on the ground so that the racket face is substantially perpendicular to the ground. In this position, the racket head may be tapped, and the racket 90 will tend to return to its original position.

Figure 9:
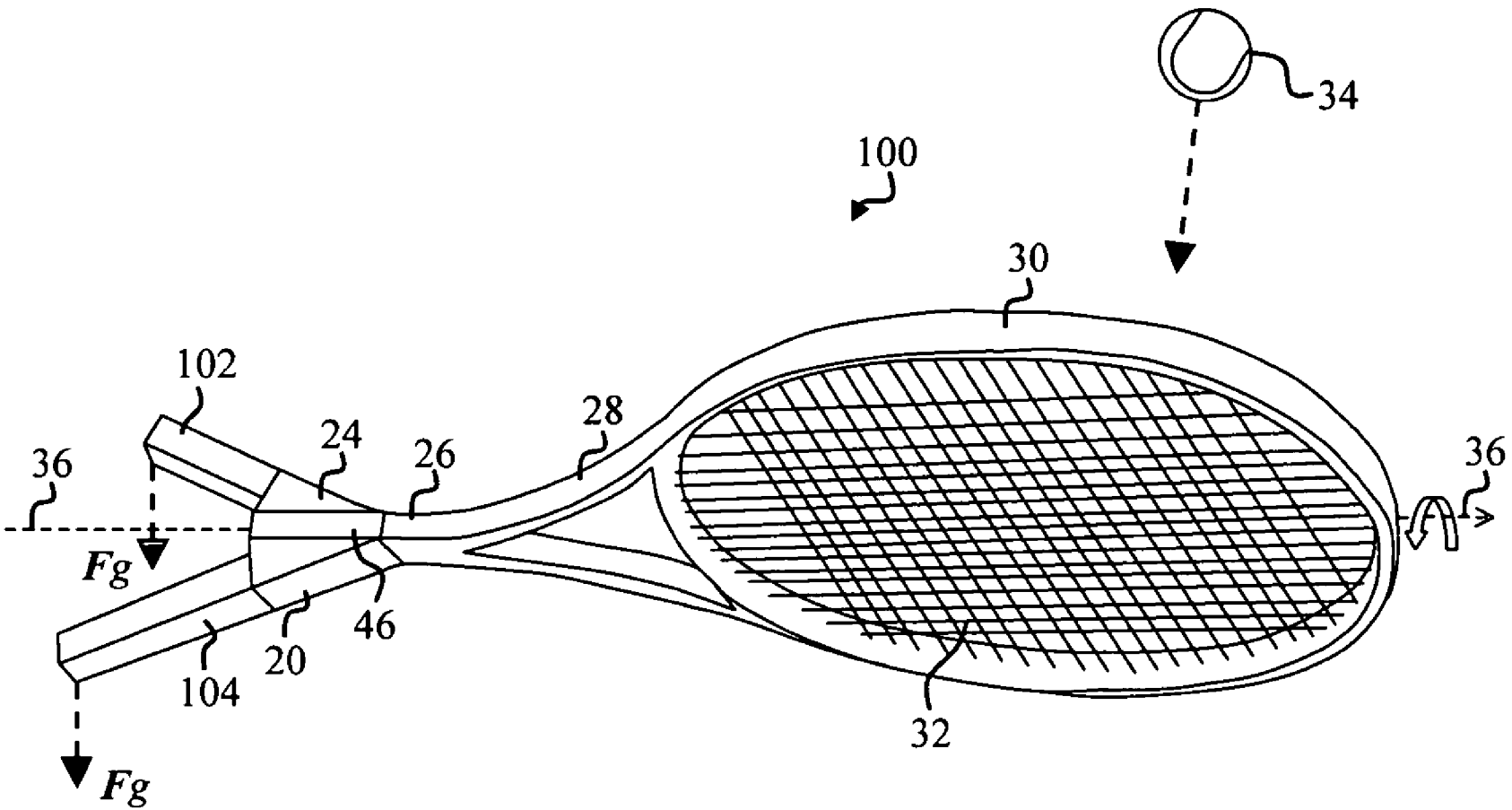
FIG. 9 is a perspective view of an alternative embodiment of the racket of FIG. 1 employing square handles and illustrating enhanced racket balance or weight distribution.

FIG. 9 is a perspective view of an alternative embodiment 100 of the racket 10 of FIG. 1. The embodiment 100 of FIG. 9 employs square handle portions 102, 104 and illustrates the enhanced stability of the racket 100. In this embodiment, the handle portions 102, 204 are telescoping. Mechanisms for telescoping the handles 102, 204 may be implemented according to the teachings of U.S. Pat. No. 4,746,119, entitled BALL-GAME RACKET WITH FOLDABLE AND SEPARABLE FRAME OR BODY, the teachings of which are incorporated herein by reference.

Use of the square handle portions 102, 104 may result in more defined grip surfaces, which may facilitate enhancing user awareness of the orientation of the racket face 32 relative to the oncoming ball 34.

For illustrative purposes, the force due to gravity (Fg) is shown acting downward on each handle portion 102, 104, illustrating gravitational effects of the handle mass distribution of the racket 100.

While the embodiments discussed herein refer primarily to tennis rackets, other types of rackets may readily be adapted in accordance with the present teachings without departing from the scope thereof. For example, ping pong paddles, badminton rackets, and so on may be fitted with a versatile multi-handle according to an embodiment of the present invention. A multi handle may be any handle that has more than one gripping surface or shaft. Similarly, a multi-handle racket, also called a multi-handled racket, may be any racket that is equipped with a multi-handle. Similarly, a conventional single-handle racket is a racket that is equipped with a single handle that is approximately in line with a longitudinal axis of the associated racket.

While dual handle rackets are primarily discussed herein, handles with more than or less than two handle portions may be employed without departing from the scope of the present invention. For example, rackets with three gripping sections or more may be employed.

Furthermore, exact materials and dimensions of various components employed to implement embodiments of the present invention are application specific. For example, the substantially rigid structure 46 of FIG. 3 may be replaced with a flexible shock-absorbing medium without departing from the scope of the present invention.

Although the invention has been discussed with respect to specific embodiments thereof, these embodiments are merely illustrative, and not restrictive, of the invention.

In the description herein, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application.

Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow "a", an and "the" include plural references unless the context clearly dictates otherwise. Furthermore, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances, some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims.

Thus, the present invention has been described herein with reference to a particular embodiment for a particular application. Those having ordinary skill in the art and access to the present teachings will recognize additional modifications, applications, and embodiments within the scope thereof.

It is therefore intended by the appended claims to cover any and all such applications, modifications and embodiments within the scope of the present invention.

Accordingly,

What is claimed is:

1. A racket comprising:

a first handle portion with a first gripping surface;

a second handle portion with a second gripping surface; and first means for coupling the first handle portion and the second handle portion to a racket frame so that the first gripping surface and the second gripping surface are angled relative to a first plane that is coincident with a hitting surface of the racket.

2. The racket of claim 1 wherein the first means includes:

a support structure adapted to at least partially surround a shaft of the racket.

3. The racket of claim 2 wherein the support structure includes:

a substantially rigid structure that includes a first mounting surface and a second mounting surface positioned on opposite sides of the substantially rigid structure.

4. The racket of claim 3 wherein the first means further includes:

second means for joining the substantially rigid structure to the first handle portion or the second handle portion.

5. The racket of claim 1 wherein the first handle portion includes:

a first shaft aligned with a first axis, and wherein the second handle portion includes:

a second shaft aligned with a second axis, wherein the first shaft and the second shaft are substantially parallel to the first gripping surface and the second gripping surface, respectively.

6. A racket comprising:

a hitting surface;

handle means coupled to the hitting surface, wherein the handle means includes:

first means for increasing-rotational inertia of the racket about a longitudinal axis of the racket over that of a conventional single-handled racket and second means for enabling a user to move a contact position of the hitting surface either closer to or further from an oncoming projectile by sliding a hand along a gripping portion of the handle means; and third means for reducing shock imparted to the hand upon impact of the hitting surface with the oncoming projectile.

7. A racket comprising:

a first handle with a first surface adapted to be gripped;

a second handle portion with a second surface adapted to be gripped, wherein the first handle and the second handle lack exterior surfaces that are substantially parallel to a longitudinal axis of the racket; and first means for coupling the first handle and the second handle to a racket frame so that the first surface and the second surface are angled relative to a first plane that is coincident with a hitting surface of the racket.

8. A racket comprising:

a first handle with a first surface adapted to be gripped; wherein a longitudinal axis of the first handle substantially intersects a longitudinal axis of the racket frame;

a second handle portion with a second surface adapted to be gripped; and first means for coupling the first handle and the second handle to a racket frame so that the first surface and the second surface are angled relative to a first plane that is coincident with a hitting surface of the racket.

* * * * *